United States Patent [19]

Laseman et al.

[11] Patent Number: 4,483,531

[45] Date of Patent: Nov. 20, 1984

[54] EXERCISE DEVICE

[76] Inventors: Lynn F. Laseman, 230 N. Elm, Waterman, Ill. 60556; Sam Poulos, 1850 Oakwood Ave., Northbrook, Ill. 60062; Michael J. Dolder, 1609 Carlisle, DeKalb, Ill. 60115

[21] Appl. No.: 399,416

[22] Filed: Jul. 19, 1982

[51] Int. Cl.[3] ..... A63B 5/08

[52] U.S. Cl. ..... 272/65; 272/100

[58] Field of Search ..... 272/65, 74, 70, 69, 272/109, 144, 146, 130, 135–140, DIG. 9, 100, 102, 66, 101; 273/342; 46/43

[56] References Cited

U.S. PATENT DOCUMENTS

| | | | |
|---|---|---|---|
| 1,248,970 | 12/1917 | Wilson-Hughes | 273/342 |
| 2,590,049 | 3/1952 | Sidlinger | 272/65 |
| 3,339,925 | 9/1967 | Nissen | 272/65 |
| 3,502,330 | 3/1970 | Cheftel | 272/65 |
| 3,584,871 | 6/1971 | Kelmon | 272/138 |
| 3,693,998 | 9/1972 | Cummins | 272/146 |
| 3,837,643 | 9/1974 | Lee | 272/146 |
| 4,008,892 | 2/1977 | Nissen | 272/100 |
| 4,045,021 | 8/1977 | Nissen | 272/65 |
| 4,225,131 | 9/1980 | Sidlinger et al. | 272/65 |

FOREIGN PATENT DOCUMENTS

| | | | |
|---|---|---|---|
| 1137660 | 11/1956 | Fed. Rep. of Germany | 272/65 |
| 2466999 | 5/1981 | France | 272/101 |

OTHER PUBLICATIONS

Nissen Gymnastic Equipment–1975 Catalog, p. 39.

*Primary Examiner*—Richard J. Apley
*Assistant Examiner*—S. R. Crow
*Attorney, Agent, or Firm*—Kinzer, Plyer, Dorn & McEachran

[57] ABSTRACT

This is an exercise device in the form of a pair of trampolines which are spaced apart but sufficiently close together such that a person can rebound from one device to the other using first one leg on one trampoline and the other leg on the other without contacting or touching the floor.

5 Claims, 2 Drawing Figures

EXERCISE DEVICE

SUMMARY OF THE INVENTION

This invention is concerned with an exercise device which is in the nature of two rebound devices of trampolines and sufficiently close together such that a person may place one foot on each trampoline and rebound from one to the other such that the bounce from the left foot on the left trampoline propels the body weight to the right where it engages the right trampoline and then back again.

A primary object of the invention is an exercise device that may be used as either a training tool for athletes or an amusement device for amateurs or both.

Another object is a exercise device which will strengthen the muscles and increase cardiovascular endurance without jarring, impact of vibratory trama to the body.

Another object is a device of the above type which will enhance balance, reflex, pivotal and directional movement skills.

Another object is a device of the above type which will allow the operator or user greater precision and accuracy for enhancement and development of specific muscle groups and/or specific directional movement skills.

Another object is a device of the above type which will maximize an athletes strength, speed and coordination while minimizing the chances of injuries.

Another object is a device of the above type which combines acceleration, deceleration and gravity in a lateral plane, the cummulative affect of which is the development of skills that are necessary for full athletic potential.

Another object is a device of the above type which eliminates most, if not all, of the shock associated with training on hard surfaces.

Other objects will appear from time to time in the ensuing specification and drawings.

DESCRIPTION OF THE PREFERRED EMBODIMENT

Figure 1:
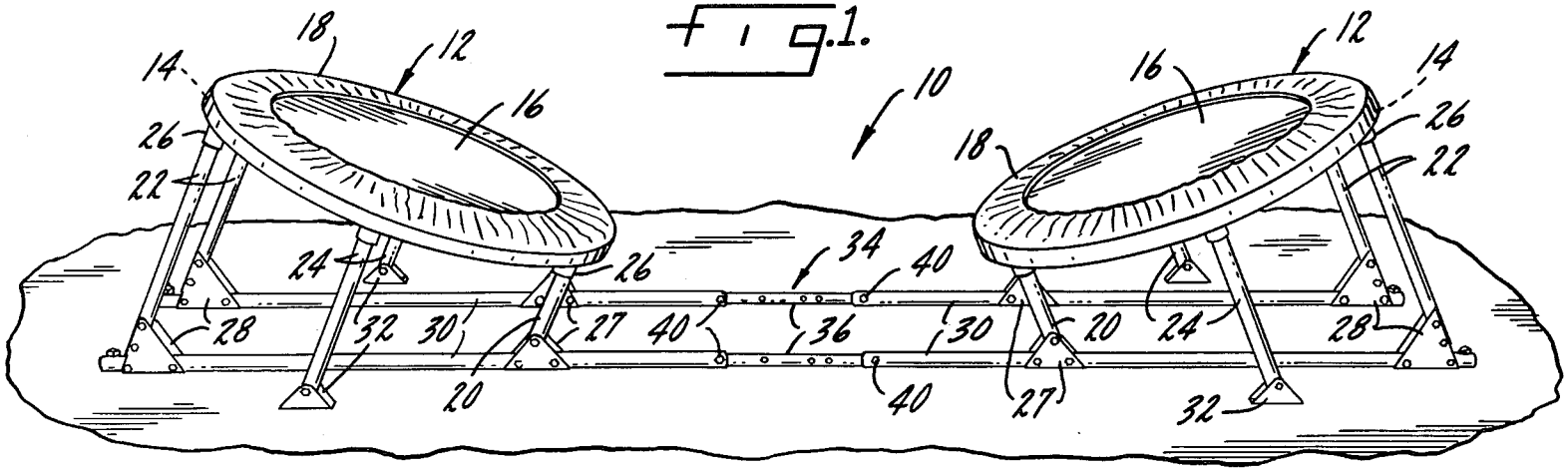
FIG. 1 is a side perspective of the exercise device.
Figure 2:
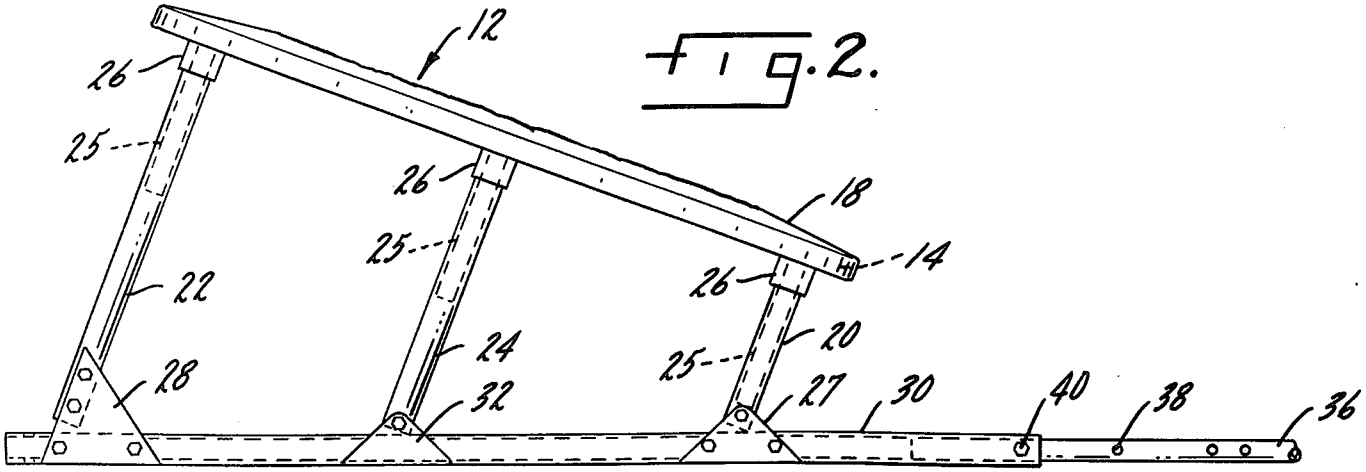
FIG. 2 is a side view, on an enlarged scale, of part of FIG. 1.

In FIG. 1 the device is indicated generally at 10 and includes two trampolines or rebound tumbling devices 12 shown as inclined toward each and relatively closely spaced. Each trampoline or rebound devices is generally circular and may be something on the order of 39 inches in diameter which should be considered merely a representative dimension for purposes of explanation and by no means a restriction. The details of each rebound device have not been shown because they may be conventional. Suffice it to say that the device may have a circular frame 14 with a spring mounted flexible member 16 disclosed within the frame, bounded around the outside by a cover or border 18.

The frame is shown as supported by six legs, two inner short ones 20, two outer longs ones 22 and two side intermediates 24. All of the legs are disposed generally at right angles to the general plane of the trampoline and therefore are at an angle to the floor or supporting surface. Each of the legs may be in the form of a tube which accepts a stub shaft 25 which depends from the trampoline. Each of the stub shafts fits in an upper socket 26 on the bottom of the frame and may be suitably held therein by screws, bolts or the like. The lower end of the inner and outer legs may be connected by suitable brackets 27 and 28 to a pair of generally parallel members 30 which may be tubes, channels, angles or any suitable structure members. It will be noted that the brackets are provided with suitable bolts of the like to make the various joints. The intermediate legs 24 have a pivoted foot 32 on the bottom thereof which accommodates itself to the supporting surface.

The inner ends of the tubes or angles 30 are adjustably interconnected to the corresponding tubes or structural members for the other trampoline by a connection generally designated 34 which may take the form of a smaller tube 36 inserted inside of the larger tubes 30 with a suitable number of openings 38, or the like, which allow connectors 40 which may be bolts or screws to provide variable spacing. Thus, the spacing between the trampolines may be varied somewhat.

The use, operation and function of the invention are as follows.

The devices is in the nature of an exercise device which include what may be considered two rebound minature trampolines disposed relatively close to each other, for example, something on the order of about 3 feet apart at their point of closest approach with each trampoline being inclined at something on the order of 20° to the horizontal. They are close enough so that a person may place one foot on the inner edge of each trampoline and to begin to rebound from one to the other. Since the trampolines are inclined and face each other somewhat, one trampoline will propel the exerciser toward the other and vice versa. The spacing between the devices may be adjusted to suit the desire of the user, depending upon where the user is more or less athletic, large or small, light or heavy, etc. The frame may be made of tubular metal perforated with holes for metal pins or the like. The trampolines are held on the frame in an inclined or angle position from the horizontal. The frames themselves may be adjustable so that the degree of inclination of the two trampolines may be varied.

It is intended that the device be used by the person mounting the device and standing upon it with one foot placed upon each trampoline. The person will then rebound or jump with the left foot on the left trampoline and the right foot on the right trampoline, alternating feet such that the bounce from the left foot on the left trampoline propels and shifts the persons body weight placing more weight upon the right foot on the right trampoline. The sequence is then repeated by a rebound or jump with the right foot on the right trampoline propelling and shifting the person's body weight and placing more weight upon the left foot on the left trampoline. The rebounding from foot to foot may be repeated at various speeds.

The inclination and spacing of the trampolines may be directly related to the speed of rebounding and the area or group of muscles that enhancement is desired for.

It is also anticipated that a hinge may be used at the point of interconnection between the two so that, for storage purposes, one trampoline could be folded over on top of the other. The device may be usable either indoor or outdoors and may be quite lightweight so that it may be easily moved around from place to place and stored.

Whereas two trampolines have been shown as interconnected, under certain circumstances, an interconnection may not be necessary. This is to say that the trampolines could be individual and may be supported by or mounted on the same surface in proximity to each other so that the action described here and above could be acquired. This is to say that it is the inclination and spacing that is important so that a person may rebound from one to the other.

Also, each of the trampolines has been shown as supported by six legs but it could be four, or for that matter, any suitable number. This is to say that any type of supporting arrangement with braces, interconnects, or what-have-you, might be used.

While two trampolines have been shown disposed 180° from each other, for certain type of exercise and/or amusement, four might be used, about 90° apart.

In addition, a line up of trampolines could be used extending linearly and alternated from one side to the other. For example, you might have 8 in one row and 8 in the other with the spacing between the rows being something on the order of 3 feet with adjacent trampolines in one row staggered or between, i.e. not directly opposite, those in the opposite row. In this case, all of the trampolines might be pitched slightly in one direction so that a user in bounding from a trampoline in one row to the next trampoline in the opposite row would be propelled slightly forward as well as to the side.

While the preferred form in several variations of the invention have been shown and suggested, it should be understood that suitable additional modifications, changes, substitutions and alterations may be made without departing from the inventions fundamental theme.

We claim:

1. In an exercise device adapted to be positioned on a surface, such as a floor, a pair of trampolines with their upper surfaces inclined toward each other at a slight angle to the horizontal and spaced sufficiently close together such that a person is able to rebound from one surface to the other on alternate feet without touching the floor, and coupling means for fixing the distance between the trampolines so that they remain in their predetermined spaced relationship.

2. The structure of claim 1 further characterized in that the trampolines are adjustably interconnected so that the distance between them may be varied.

3. The structure of claim 1 further characterized by and including a frame upon which the trampolines are mounted, the frame interconnecting trampolines in a manner such that the frame functions as a base to contact the floor.

4. The structure of claim 1 further characterized in that the trampolines are on the order of three feet apart at their point of closest approach.

5. The structure of claim 1 further characterized in that each of the trampolines is circular and is on the order of 39 inches in diameter.

* * * * *